United States Patent [19]

Waldron

[11] Patent Number: 4,942,709

[45] Date of Patent: Jul. 24, 1990

[54] DISPLAY PANELS AND CONNECTOR SYSTEM THEREFOR

[76] Inventor: Michael P. Waldron, 2041 Tustin Ave. #A, Costa Mesa, Calif. 92627

[21] Appl. No.: 327,386

[22] Filed: Mar. 22, 1989

Related U.S. Application Data

[63] Continuation of Ser. No. 129,780, Dec. 7, 1987, abandoned.

[51] Int. Cl.[5] ..... E04B 1/40

[52] U.S. Cl. ..... 52/285; 52/585; 52/586

[58] Field of Search ..... 52/285, 585, 586, 242, 52/239, 288, 582

[56] References Cited

U.S. PATENT DOCUMENTS

| | | | |
|---|---|---|---|
| 1,009,469 | 11/1911 | Burrowes . | |
| 1,020,645 | 3/1912 | Hall . | |
| 1,724,333 | 8/1929 | Williamson . | |
| 1,732,190 | 10/1929 | Daman | 52/285 |
| 1,809,508 | 6/1931 | Colby . | |
| 2,133,204 | 10/1938 | Max | 52/585 |
| 2,148,575 | 2/1939 | Newlin et al. . | |
| 2,243,316 | 5/1941 | Larsen . | |
| 2,694,614 | 11/1954 | Dent . | |
| 2,963,828 | 12/1960 | Belliveau | 52/585 |
| 3,124,858 | 3/1964 | Blonde . | |
| 3,239,986 | 3/1966 | Russell . | |
| 3,280,526 | 10/1966 | Pepitone | 52/585 |
| 3,293,813 | 12/1966 | Emmons et al. . | |
| 3,315,427 | 4/1907 | Frye . | |
| 3,343,301 | 9/1967 | Adelman . | |
| 3,349,528 | 10/1967 | Salt | 52/585 |
| 3,416,277 | 12/1968 | Wood et al. . | |
| 3,466,823 | 9/1969 | Dowling . | |
| 3,473,273 | 10/1969 | Gunkel . | |
| 3,566,561 | 3/1971 | Tozer | 52/242 |
| 3,823,521 | 7/1974 | Heitholt et al. | 52/285 |
| 3,848,382 | 11/1974 | Rensch . | |
| 3,848,388 | 11/1974 | Bretche . | |
| 3,888,055 | 6/1975 | Gallo . | |
| 4,002,261 | 1/1977 | Litchfield . | |
| 4,185,430 | 1/1980 | Gartung . | |
| 4,186,533 | 2/1980 | Jensen | 52/285 |
| 4,258,856 | 3/1981 | Marling . | |
| 4,270,324 | 6/1981 | Schaefer . | |
| 4,391,077 | 7/1983 | Giess . | |
| 4,491,166 | 1/1985 | Hanna . | |
| 4,601,137 | 7/1986 | Bates | 52/242 |
| 4,712,336 | 12/1987 | Backer | 52/71 |

FOREIGN PATENT DOCUMENTS

| | | | |
|---|---|---|---|
| 2010667 | 9/1971 | Fed. Rep. of Germany | 52/285 |
| 2733-283 | 2/1979 | Fed. Rep. of Germany | 52/285 |
| 510021 | 7/1920 | France | 52/585 |
| 605686 | 3/1959 | Italy . | |

*Primary Examiner*—David A. Scherbel
*Assistant Examiner*—Caroline D. Dennison
*Attorney, Agent, or Firm*—Larson and Taylor

[57] ABSTRACT

A display component for an exhibit or the like. The generally rectangular panels which make up an exhibit have peripheral edges formed with elongated channels parallel thereto which are entered through entry openings located in the edges adjacent to that edge. Connector members include generally flat bases from which locking pins extend perpendicularly, each pin having a flag adjacent thereto. To connect a plurality of panels together, the pins of a given connecting member enter the entry openings and hence pass along the channels of two panels which are to be joined as the flags associated with each of the pins engages in a slot along that edge of the panel which is engaged by its respective pin.

29 Claims, 9 Drawing Sheets

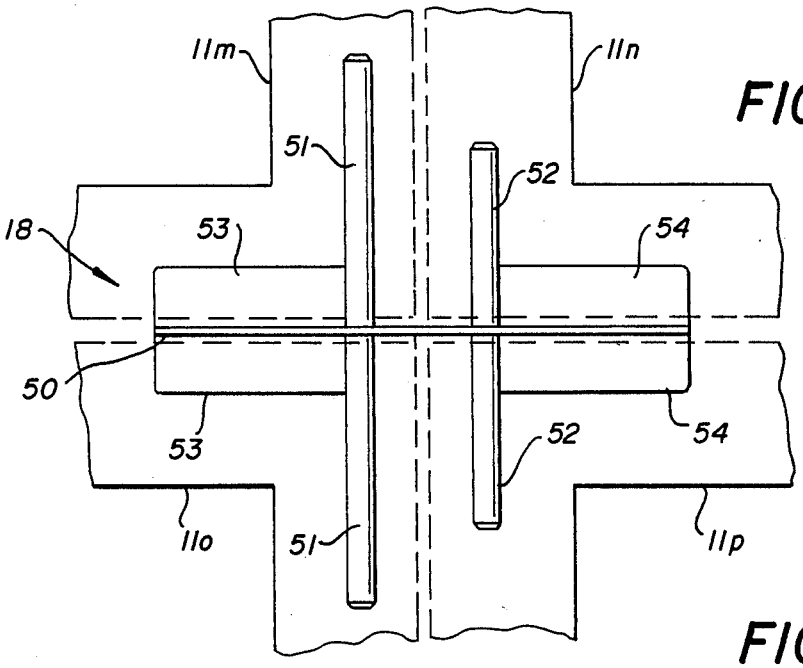
FIG. 11
FIG. 12
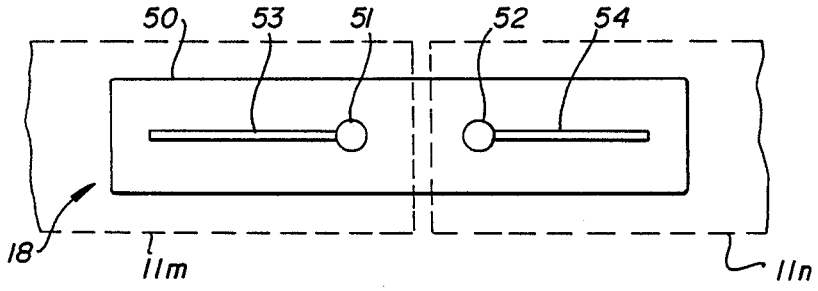
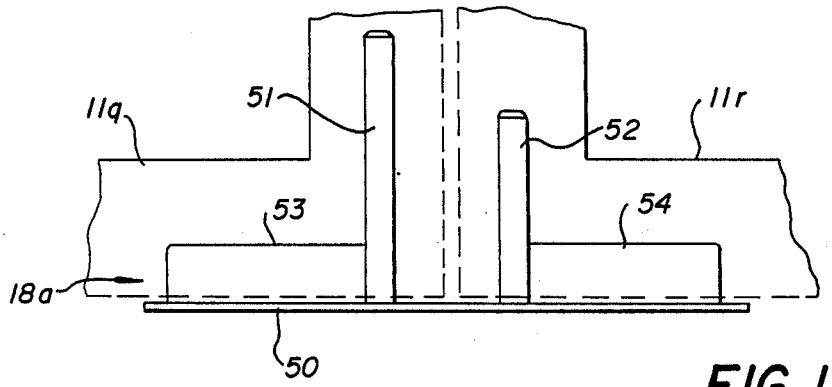
FIG. 13

DISPLAY PANELS AND CONNECTOR SYSTEM THEREFOR

This application is a continuation, of application Ser. No. 07/129,780 filed Dec. 7, 1987, abandoned.

FIELD OF THE INVENTION

This invention relates to a display system for exhibits and the like made of individual display panels, and in particular it relates to a connector system therefor.

BACKGROUND OF THE INVENTION

In numerous environments, the most noticeable being trade shows and the like, the need exists to build an exhibit which is highly attractive so that it will attract potential customers. If a given exhibit is of sufficient importance or if it is to remain in place for an extended period of time, the exhibitor might be willing to have the exhibit custom built, notwithstanding the fact that a custom built exhibit is costly and must be essentially demolished when the usefulness of the exhibit is finished. The difficulty, however, is that most exhibits tend to have a rather short life, perhaps only a few days or at a maximum, a few weeks. In this case, which is the more common situation for trade show exhibits and the like, it will be more difficult for the exhibitor to justify the extensive costs of a custom built exhibit. This economic limitation on the costs which can be applied to a relatively short lived exhibit will often result in a less attractive or less impressive exhibit which will render it impossible to maximize the main purpose of the exhibit itself, namely to attract a maximum number of customers or potential customers.

To overcome this difficulty, attempts have been made heretofore to develop a system of panels which can be assembled together into an attractive exhibit and then disassembled and stored or transported for future use. An example of this concept is shown in U.S. Pat. No. 4,491,166 to Hanna.

Another approach, which has been used by the Assignee of the present application for several years, comprises a plurality of panels, generally rectangular, having an open, central U-shaped groove extending along the periphery of all four edges thereof with a lateral U-shaped groove extending alongside both sides of each central grooves. The two lateral U-shaped grooves are used to attach the decorative material such as fabric or the like which covers the face of the panel. The central U-shaped groove was used to connect adjacent panels together by inserting a relatively flat rod (shaped like a ruler, yard stick or the like, but somewhat thicker and having rounded sides) into the two facing central grooves of two separate panels brought together edge-to-edge.

However, these prior attempts to provide an assimilable and disassembiable, and hence reusable, exhibit have not been completely successful A primary difficulty has been the inability to provide a versatile and yet strong connector system which will permit the panels to be connected together in many different configurations, be sufficiently strong to assure the structural integrity of the exhibit during the full length of time that it is in place and still allow for relatively simple assembly and disassembly of the exhibit.

SUMMARY OF THE INVENTION

A purpose of the present invention is to provide an arrangement in assemblable and disassemblable display panels for an exhibit or the like which has a connector system which overcomes the disadvantages of the prior art. More specifically, it is a purpose of the present invention to provide a connector system for assemblable and disassemblable panels which, when assembled, is equally or more attractive than a custom built exhibit, but which includes individual display panels and a connecting system for these panels which is versatile, strong and easy to use.

An additional advantage derived from the use of the present versatile, strong and easy to use connector system is that it allows design flexibility rivaling that of a custom exhibit by allowing shapes and proportions which were previously obtainable only through the use of custom built exhibits. Moreover, the connector system of the present invention will facilitate reconfiguration of a given set of panels when assembled a second and subsequent times. This connector system will also provide an exhibit having the clean look of a solid structure, utilizing the high internal strength provided by the panels and the connecting system with the clean lines of a custom exhibit.

These purposes of the present invention are achieved by providing a connector system including connector members and display panels having specially constructed peripheral edges which cooperate with the connector members.

The peripheral edges of the display panels are provided with a channel which extends parallel to each panel edge but is spaced inwardly therefrom such that the boundary of the channel closest to its respective parallel edge is of reduced cross-section relative to the greatest cross-sectional dimension of that channel. The channel extends for the full length of its respective panel edge, terminating at entry openings around the corners from its parallel edge, opening into the two adjacent edges. Each peripheral edge also includes a slot which extends along the center of each edge, is of a thickness less than the greatest dimension of the channel associated with that edge and extends downwardly into the edge at least part of the way towards the said channel.

The connector members which cooperate with the specially designed panel edges comprise a base and at least two elongated locking pins extending perpendicular to the base and a pair of flags also extending perpendicularly from the base, each flag being associated with a locking pin.

To assemble panels using the present invention, two panels are brought together, edge-to-edge, in the relationship that those panels will assume in the finished exhibit. One locking pin of a connector member is inserted into the entry opening of a channel (that is, the opening around the corner from the respective parallel edge of that channel) and the flag is inserted into the central slot immediately adjacent to the entry opening into which the pin has been inserted, and on the side of the pin away from the adjacent corner of the panel. A second panel is then brought into similar association with the second pin of the connector member and its associated flag.

The width of the flag is only slightly less than the width of the central slot. This, coupled with the predetermined length of the flag along the slot, very positively positions the connector member relative to the panels.

An entire exhibit will include many connector members of different configurations to accommodate the different shapes, cornering situations and the like in an overall exhibit. For example, a connector member can comprise a base with a pair of pins extending in the same direction from that base, each pin having a flag also extending from the base in the same direction. Such a connector member would be used for connecting two panels together with the connecting member running along the two edges of the two panels which are a continuation of each other and are around the corner from the panel edges which actually abut each other. In another arrangement, the two pins can extend along a common line, one on each side of the base, such that the pins would engage directly into the two meeting panel edges.

Numerous other connector member configurations are possible. For example the base can turn at any angle, preferably ninety degrees but also at any other angle, so that the connector member can join panels together at a angle to each other rather than in a common plane.

Of course it is possible to provide connector members with one or all of the features described above, e.g., it can have a pair of pins extending outwardly from each side of the base Such pins would be used for example where four panels would come together, two on each side of the connector member. And of course this connector member having four pins can also be formed at an angle so as to connect together four panels wherein two of them lie in a plane which forms an angle with the plane of the other two.

According to certain detailed advantageous features of the present invention, the pins on a given side of the base may be of different heights. This simplifies assembly by allowing the longer pin to be inserted first and while at least its tip is located within its respective channel entry opening, the remainder of the connector member is free to turn about that pin to facilitate locating the second pin with respect to its intended channel entry opening. According to another advantageous structural feature of the present invention the flags can either be formed as pieces separate from the base and welded thereto and also welded to their respective pins or the flags can be formed from the material of the base itself, bent at a ninety degree angle to the remainder of the base.

Hence, it is an object of the present invention to provide a new and improved display panel connecting system for use in exhibits and the like.

It is still another object of the present invention to provide a new and improved connector system for an exhibit formed of assemblable and disassemblable panels which permits the exhibit to achieve the strength and attractiveness of a custom built exhibit while still having the cost benefit of being assembled and then disassembled for subsequent storage or reuse.

It is still another object of the present invention to provide a connector system for an exhibit or the like wherein the display panels comprise specially formed edges having channels with side entry openings and central slots, in combination with a connector member having pairs of pins for engaging the channels and adjacent flags for engaging the slots, which system is versatile and strong.

It is another object of the present invention to provide a connector member for connecting display panels for an exhibit or the like, which connector member has a base, at least two pins projecting outwardly from that base and a flag projecting out from that base and associated with each pin.

These and other objects of the present invention will become apparent from the detailed description to follow.

BRIEF DESCRIPTION OF THE DRAWINGS

There follows a detailed description of preferred embodiments of the present invention which is to be read together with the accompanying drawings, wherein:

FIG. 11 is a side elevational view of a second type of connector member.

FIG. 12 is a top plan view of FIG. 11.

FIG. 13 is a modified version of the type of connector member shown in FIGS. 11 and 12.

DETAILED DESCRIPTION OF THE PREFERRED EMBODIMENTS

There follows a detailed description of preferred embodiments of the present invention, wherein like elements are represented by like numerals throughout the several views.

Figure 1:
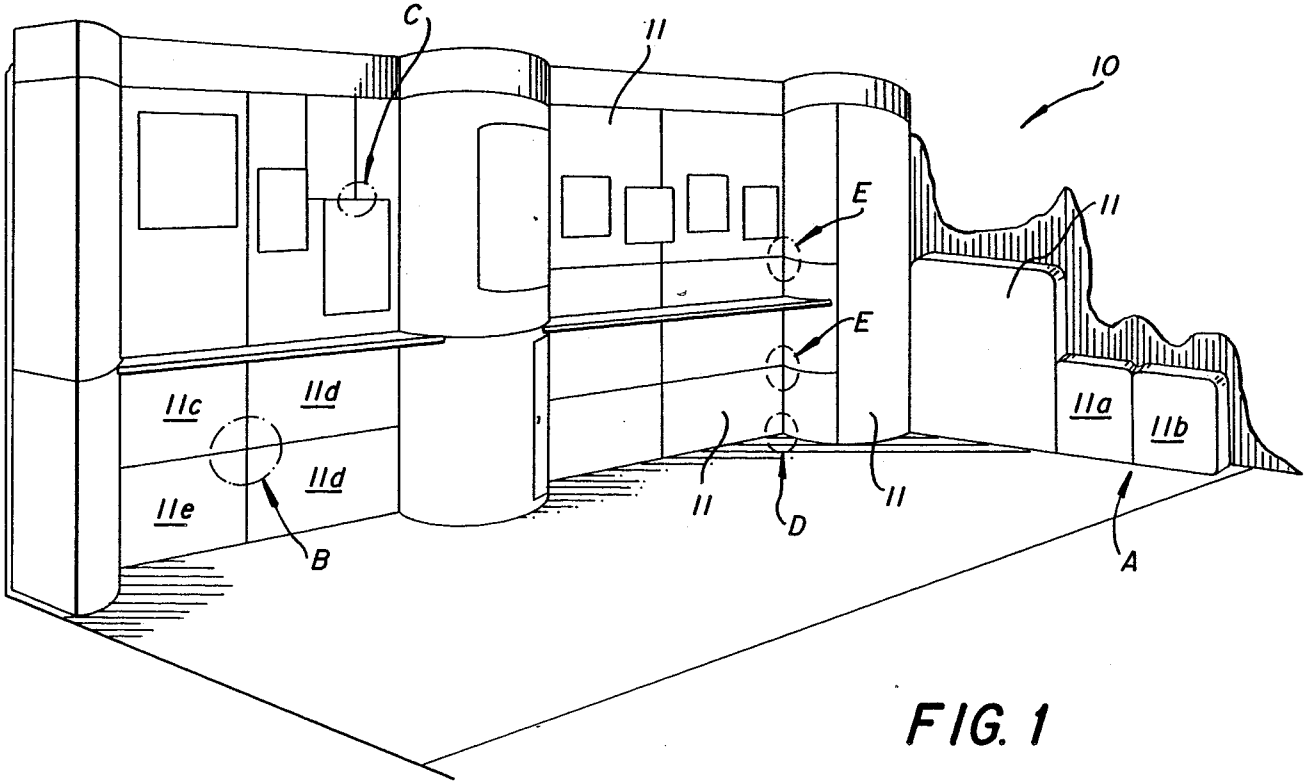
FIG. 1 is a perspective view of a typical exhibit of the type formed by the display panels and connector system of the present invention.

FIG. 1 illustrates a typical trade show exhibit 10 of the type which can be constructed by building up individual display panels and connecting them with the connector system of the present invention. As is evident from FIG. 1, the panels can be generally flat or curved to form curved pillars. Virtually any other shape is also possible. Some of the individual panels are designated by the numeral 11. The letters A, B, C, D and E, and the arrows therefrom designate portions of the exhibit 10 which will be described in greater detail below.

Figure 2:
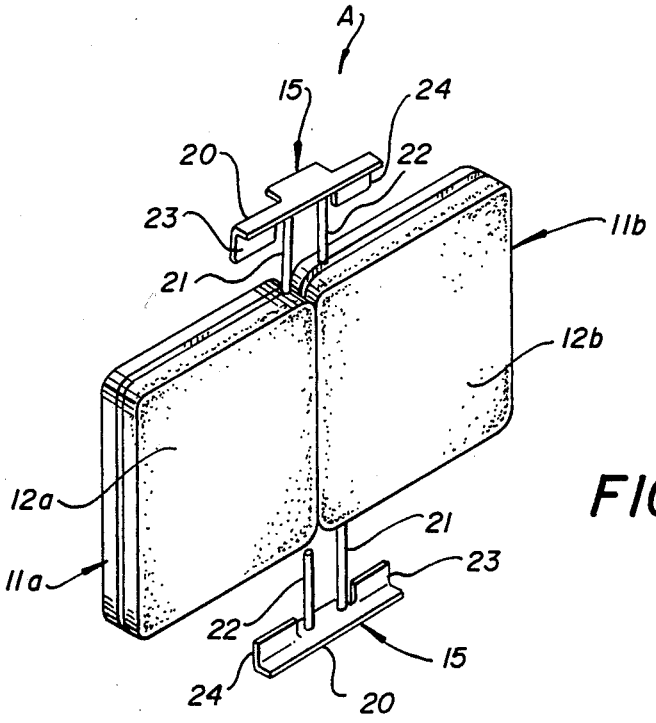
FIG. 2 is a perspective view illustrating two panels in the vicinity of the arrow A of FIG. 1, separated from the exhibit with the connector members partially removed from their respective panels.

FIG. 2 is a perspective view of the two panels 11*a* and 11*b* located at area A at the right hand side of FIG. 1, removed and isolated from the exhibit itself and with the connector members removed for purposes of illustration.

Referring to FIG. 2, the connector members 15 are of a first type which will be described in greater detail in FIGS. 8–10 below. This connector member includes a base piece 20 and a pair of locking pins 21 and 22 projecting outwardly therefrom. One of these locking pins 21 is longer than the other, 22. The connecting member also includes a flag 23 adjacent the longer pin 21 and another flag 24 adjacent the shorter pin 22. These flags are generally flat pieces which extend perpendicular to the plane of the base 20. In this particular embodiment, the flags 23 and 24 are formed by bending a portion of the base 20 until they are perpendicular thereto. The purpose of having one pin longer than the other is simply to facilitate inserting the pins into respective holes in the panels. Very simply, the longer pin can be inserted first and after it is caught in its respective hole, the connector member can be turned as required to align the shorter pin 22 with its hole. Thereafter, the connector member is pushed down into the panels 11*a* and 11*b* to link them together. In this embodiment of the connector member (or in the second embodiment of the connector member to be discussed below) the longer pin should be no more than two inches and the shorter pin should be no less than on inch. An outer limit of two inches is preferable to effect a proper connection since, and if a pin is longer, it will simply provide an increased and unnecessary possibility of jamming. On the other hand, a length of at least one inch is generally preferable to assure proper strength and rigidity.

As will be apparent in the following discussion, the panels 11*a* and 11*b* are formed by hollow rectangular frame pieces, arranged generally in the shape of a picture frame. The decorative nature of the outwardly facing surfaces is formed by covering the frame with fabric materials 12*a* and 12*b*, these materials being secured in the edge structures of the panels 11*a* and 11*b*, respectively, in a manner to be described below. Thus, it will be seen that by connecting together a large number of panels 11 with decorative coverings 12, using panels 11 of all desired sizes and shapes, one can build up a display exhibit of virtually any size and shape, FIG. 1 being one example thereof, with the individual panels running together to provide a smooth attractive appearance much like a custom built exhibit, without ugly erector-set like seams between the panels. The present connector system permits versatility in selecting and arranging the respective panels and assures that the connection will resist shear and stress forces regardless of the direction of the applied load.

Figure 3:
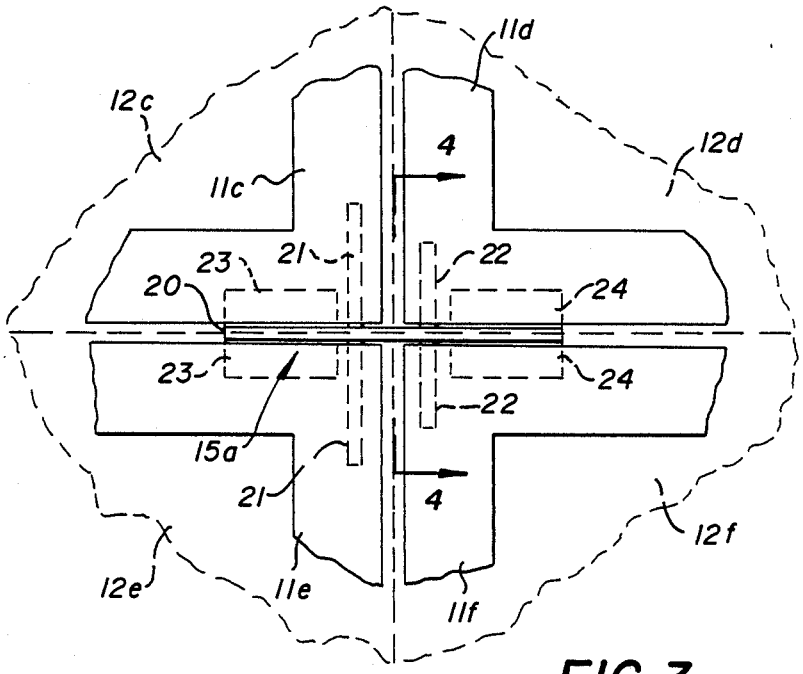
FIG. 3 is an enlarged view of location B of the exhibit of FIG. 1, whereat four different panels come together, but with the cover material removed to reveal the underlying panels.

FIG. 3 illustrates in an enlarged view the corner are B where the four generally flat panels 11*c*, 11*d*, 11*e* and 11*f* meet. The connector member 15*a*, which is out of view and which is therefore shown in dotted lines in FIG. 3, is actually similar in shape to the connector member shown in FIG. 11, as will be described in greater detail below, although the connector member shown in FIG. 3 is of the first type with bent up flags rather than the second type shown in FIG. 11 with a welded o flag.

Referring to FIG. 3, the base piece 20 is somewhat similar to that shown in FIG. 2 except that it is duplicated above and below the base plate, so that the pins and flags extended upwardly and downwardly from a common base plate. The longer pins 21 with their flags 23 engage into the panels 11*c* and 11*e* while the shorter pins 22 with their respective flags 24 are engaged into the display panels 11*d* and 11*f*. Also illustrated schematically in FIG. 3 are the decorative covers 12*c* through 12*f*.

Figure 4:
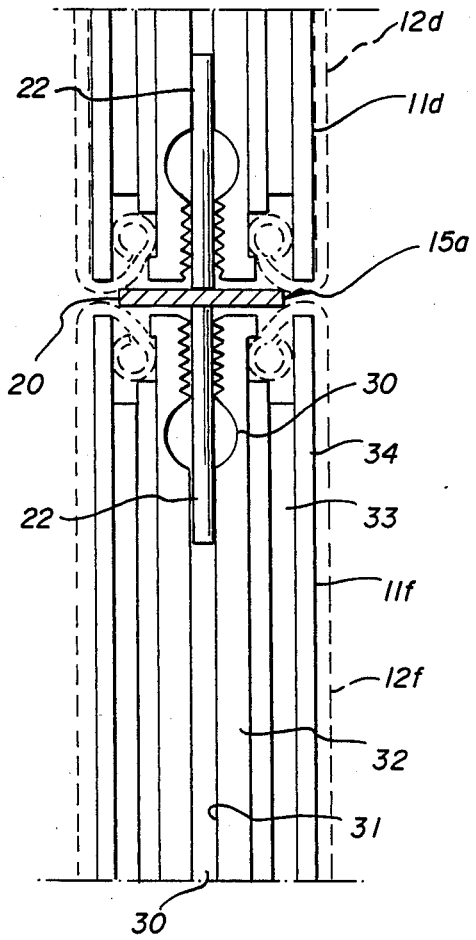
FIG. 4 is an enlarged cross-sectional view taken along line 4—4 of FIG. 3.
Figure 5:
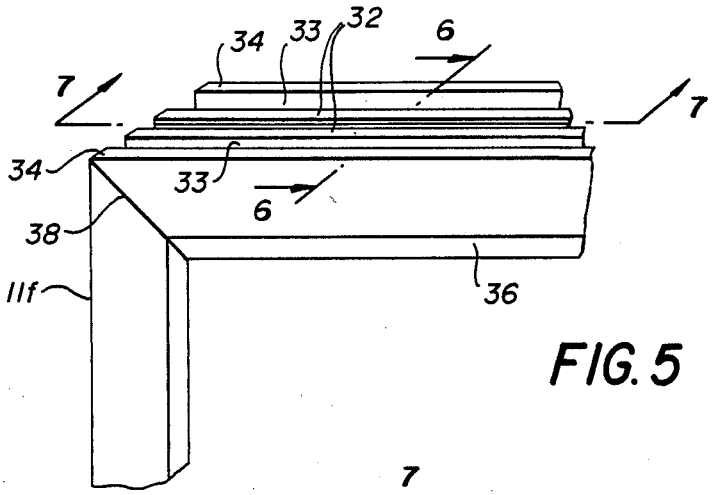
FIG. 5 is a perspective view of the corner portion of a frame piece of a display panel.
Figure 6:
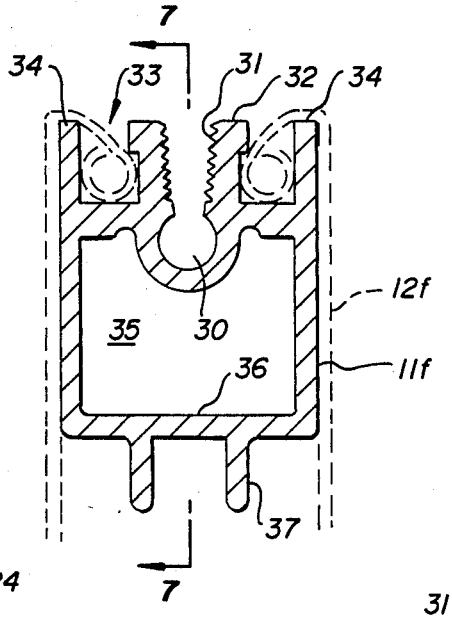
FIG. 6 is an enlarged sectional view taken along line 6—6 of FIG. 5.
Figure 7:
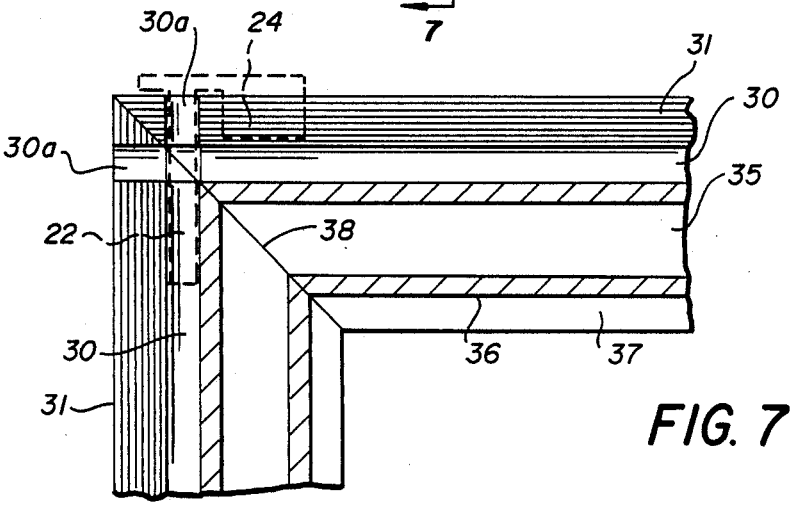
FIG. 7 is a longitudinal sectional view taken along lines 7—7 of both FIG. 5 and FIG. 6.

FIG. 4 illustrates the panels 11*d* and 11*f* in greater detail and for a better understanding of this figure, reference is also made to FIGS. 5 through 7 which illustrate the construction of the underlying frame, absent any decorative covers or connecting members. Referring to FIGS. 5 through 7, the individual panels generally comprise four sides connected together at their corners. These sides, or frame pieces are aluminum extrusions, preferably a high quality 60–63 alloy. They preferably have a wall thickness in the range of 0.062 inches and are designed to be lightweight, manageable and yet have high shear and stress resistance. Referring to FIG. 6, a preferred dimension would be 0.8 inches across and one inch in height. The large central void 35 contributes to the light weight nature of the framework.

Referring to all of FIGS. 5 through 7, each panel edge includes a circular cross-section central channel 30 which extends for the full length of its respective edge, even crossing over the corner connection with an adjacent edge to pass out that adjacent edge through an entry opening 30*a*. The channel 30 has a reduced cross-section where it borders the slot 31, i.e., reduced relative to the greatest cross-section of the channel 30 itself. As illustrated in the figures, the slot 31 is threaded to allow for ease of fastening anything along any point on the edge. However, the greater importance of the slot 31 is that this slot, which extends along the entire length of the edge, receives the flags of the connector members which are provided adjacent their respective pins.

This slot 31 is formed between a pair of central partitions 32, on the outer sides of which are formed spline openings 33 between partitions 32 and side walls 34. As illustrated in dotted lines in FIGS. 4 and 6, these spline openings 33 are adapted to receive the tubular edges of the decorative fabric coverings 12. Preferably, these tubular edges are removably received in the spline openings 33 so that they can be removed in order to replace the decorative fabrics with other decorative fabrics. The interiors of the frame pieces which form the panel edges are bordered by inside wall 36 from which a pair of inner ribs 37 extend toward the center of the panel. These ribs 37 have several functions. First, they can be used to mount Plexiglass sheeting or the like, thus expanding the versatility of the panel. In addition, even when the ribs 37 are not used for this purpose they provide extra strength to the panel.

Each individual frame piece of the panel is cut at a forty-five degree angle and joined to an adjacent frame piece along a miter joint 38, whereat the two pieces are then welded together. The welded miter joint provides proper strength for extending the channel openings 30 thereacross to their respective entry openings 30*a*.

To facilitate understanding the relationship between each connector member and the respective channels and slots of a panel, a portion of the connector member 15*a* corresponding to the lower right hand portion of FIG. 3 is superimposed in dotted lines on FIG. 7. The pin 22 extends through the upper entry opening 30*a* and down into that vertical channel 30. Since the slot 31 adjacent to that vertical channel 30 is opened along the entire vertical length of that vertical edge, the pin 22 will be visible from the left hand side of FIG. 7, as it is indeed visible in FIG. 4 The flag 24 will then fit down into the horizontally extending slot 31, thus assuring that this pin 22 is prevented from rotating about its axis.

FIG. 4 illustrates the relative positioning of all of the elements described above Note in particular that the adjacent fabric coverings such as 12*d* and 12*f* come together tightly in the small gap between the side walls 34 over which they must pass into their respective spline openings 33. The size of this gap is determined by the thickness of the base 20 which limits movement of the panels 11*d* and 11*f* towards each other.

FIGS. 8 through 19 illustrate on an enlarged scale a number of different connector members, all of which include the basic features of the present invention, as described above. There are two basic connector members, a first type as shown in FIGS. 2 and 8 through 10 wherein the flag is formed as a bent up portion of the base and a second type as shown in FIGS. 11 through 19 wherein the flag is a separate piece of material from the base and is welded thereto along one of its edges and preferably welded to its respective locking pin along a second of its edges.

Figure 8:
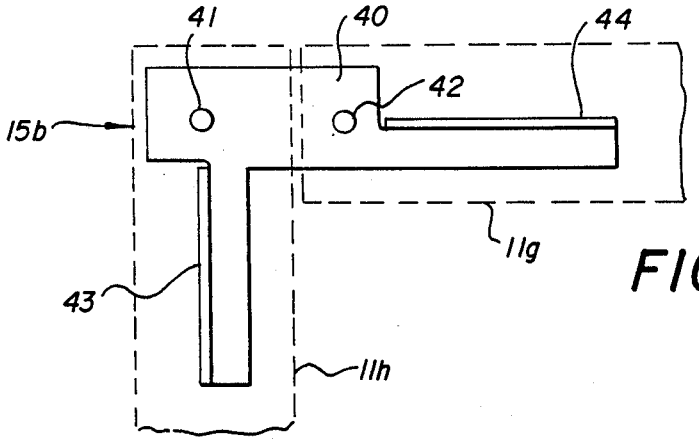
FIG. 8 is a top plan view of a first type of connector member.
Figure 9:
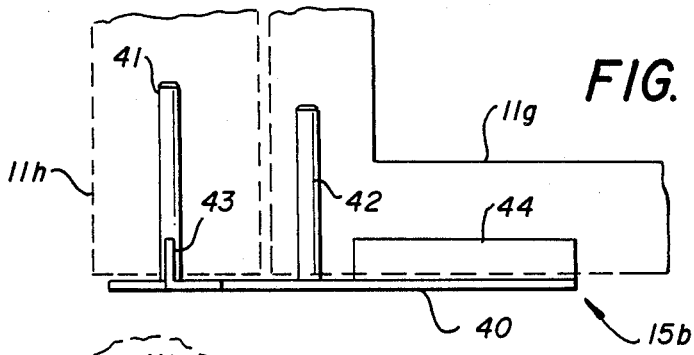
FIG. 9 is a side elevational view of FIG. 8.

FIGS. 8 and 9 show a connector member 15*b* which is similar to the connector member 15 of FIG. 2 except that it is bent at a ninety degree angle so as to join together the panels 11*h* and 11*g* at such an angle. If the panel 11*g* were slightly curved upwardly in FIG. 8, this connection might be used for example in area D of FIG. 1 where a lower generally flat panel 11 joins with a lower panel of the cylindrical corner pillar.

In this embodiment, there are provided long and short locking pins 41 and 42 with respective flags 43 and 44, both flags having been bent upwardly at a ninety degree angle from the remainder of the base 40.

Figure 10:
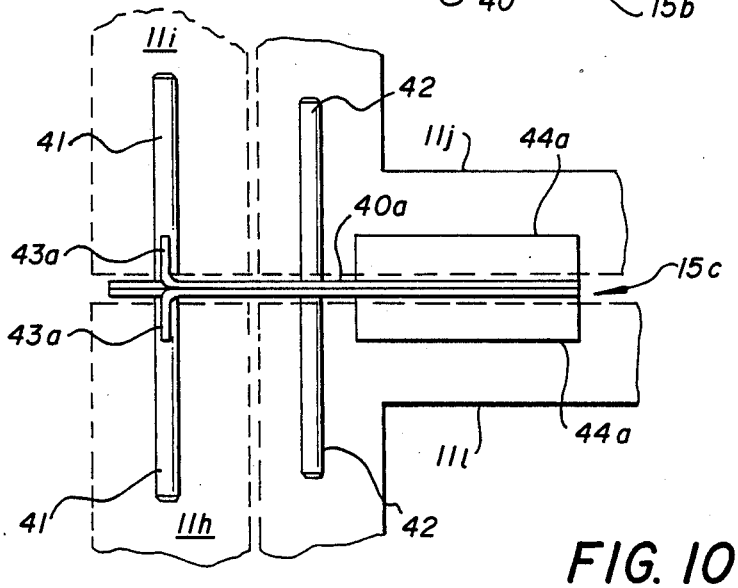
FIG. 10 illustrates a modified version of the type of connector member shown in FIGS. 8 and 9.

FIG. 10 illustrates a modification 15*c* of the embodiment of FIGS. 8 and 9 to add a mirror image therebeneath in the form of lower pins 41 and 42 with respective lower flags. This embodiment would be used for example in the area E of FIG. 1 which is similar to area D except that panels are provided above and below the joint, i.e., four panels come together, two in one plane and two at an angle to that plane. In this embodiment, in order to assure that the base is of a predetermined thickness, i.e., the same thickness as base 40 of FIGS. 8 and 9, so as to control the gap between the abutting panel edges, it may be necessary to form the base 40 out of two thinner pieces 40*a*. Thus in this case the bent up flags are somewhat thinner than in FIGS. 8 and 9 and are designated herein as 43*a* and 44*a*, respectively. In FIG. 10, the two planar panels are shown in edge view at 11*i* and 11*k* while the two panels which turn into the column are designated as 11*j* and 11*l*.

FIGS. 11 and 12 illustrate a connector member 18 formed by a base 50, two sets of pins 51 and 52, each having respective flags 53 and 54. The panels 11*m*, 11*n*, 11*o* and 11*p* connected by this connector member can be four essentially planar panels meeting at a common point corresponding to the area B of FIG. 1 or a set of two planar panels 11*m* and 11*o*, meeting two curved panels 11*n* and 11*p*, meeting at area E. The connector member 18 of FIG. 11 is a different type from the member 15 shown in FIGS. 2 and 8 through 10 in that the base 50 is a flat plate which is of a uniform width throughout its length. That is, no portion thereof is bent up as in FIGS. 2 and 8 through 10. Rather, in this embodiment the flag members 53 and 54 are separate flat pieces which are welded to the base 50 along one of their edges and then for additional strength, welded to their respective pins along a second of their edges. While both types of connector members are equally operable in the present invention, they do have different advantages. The type shown in FIGS. 8 through 10 with the bent up flags is somewhat more economical, while the type shown in FIGS. 11 through 19 with the welded on flags is somewhat stronger and hence better suited for higher stress applications.

The connector member 18*a* of FIG. 13, which connects panel members 11*q* and 11*r* is essentially identical to the member 18 shown in FIGS. 11 and 12 except that it does not include a lower set of pins and flags.

Figure 14:
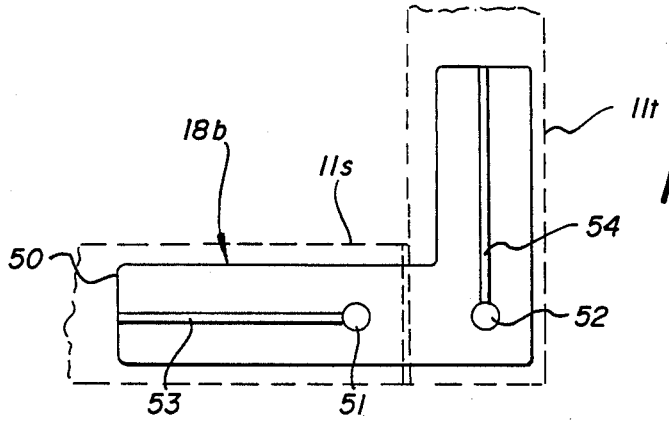
FIG. 14 is a top plan view of another modified version of the type of connector shown in FIGS. 11 and 12.
Figure 15:
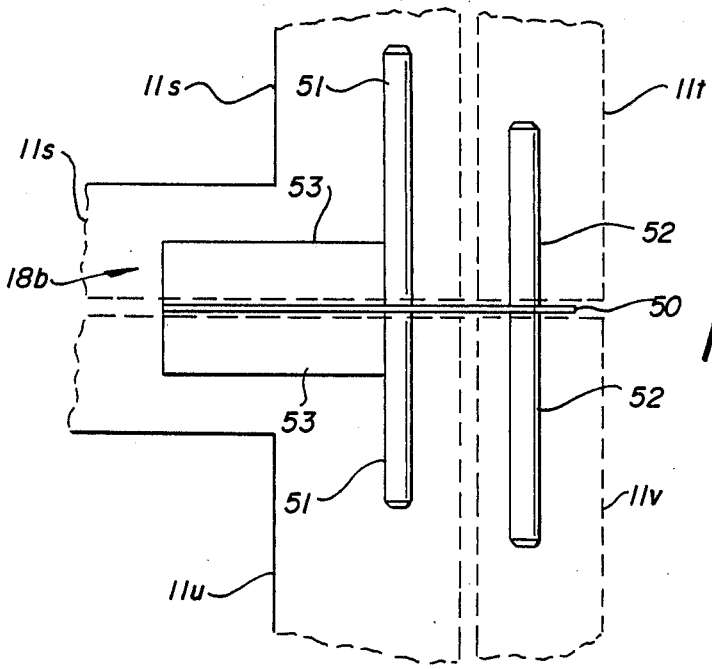
FIG. 15 is a side elevational view of FIG. 14.

Connector member 18*b* of FIGS. 14 and 15 is the same type of connector member as 18 and 18*a* shown in FIGS. 11 through 13, but bent at ninety degrees like the connector members shown in FIGS. 8 through 10 to connect the panels together at a ninety degree angle. FIGS. 14 and 15 show this second type of connector member with the pins and flags arranged on both sides of the base, similar to that shown in FIG. 10. In this case, however, the base 50 is the same base whether the pins are mounted on one side or both sides.

Figure 16:
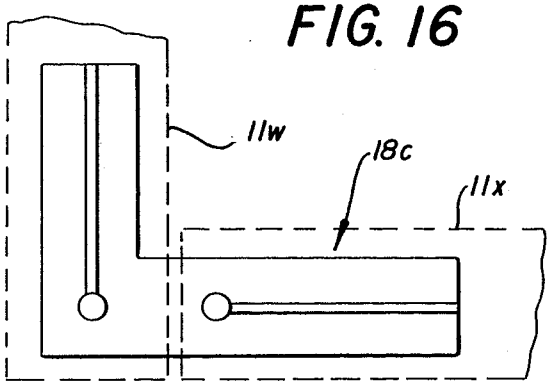
FIG. 16 is a top plan view of another modified version of the type of connector member shown in FIGS. 11 and 12.

FIG. 16 shows a connector member 18*c* similar to 18*b* of FIGS. 14 and 15 except that it is used for an opposite corner. In FIG. 14 the left hand panel 11*t* extends to the actual corner while the lateral panel 11*s* starts from the side of panel 11*t*. In FIG. 16 the left hand panel 11*w* extends to the actual corner while the right hand panel 11*x* starts from the lower left hand corner of panel 11*w* and extends to the right.

Figure 18:
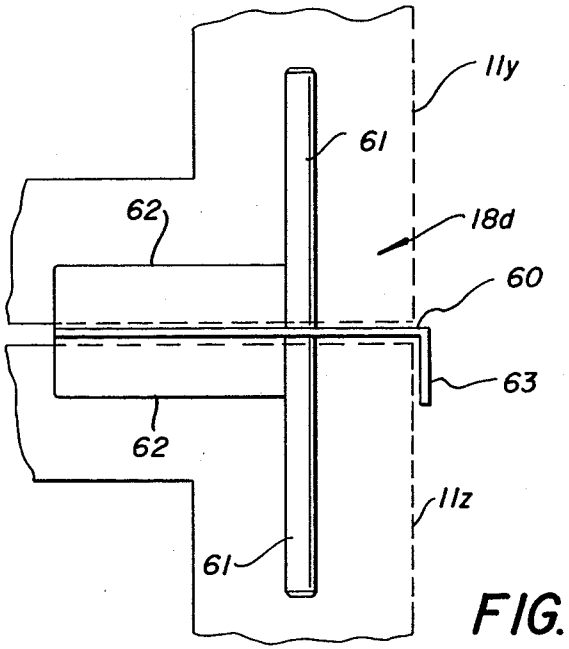
FIG. 18 is a side elevational view of FIG. 17.
Figure 17:
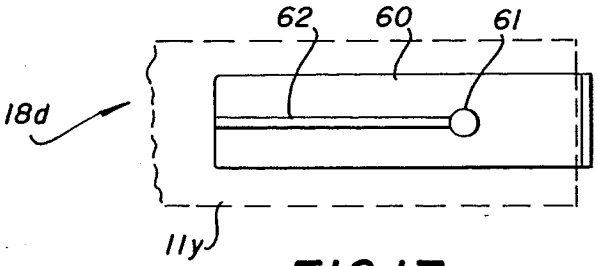
FIG. 17 is a top plan view of another modified version of the type of connector member shown in FIGS. 11 and 12.

FIGS. 17 and 18 illustrate a modification 18*d* which is used at an outermost lateral edge of the exhibit where it is necessary to attach panels above and below the connector member but where there are no panels outwardly to the side thereof. In this case the connector member 18*d* includes a base 60 having upwardly and downwardly extending pins 61, each with its respective flag 62 for connecting together panels 11*y* and 11*z*. In this case, however, the end of the base member 60 away from the flags includes a perpendicular flange 63 which extends along the side of one of the display panels 11*y* or 11*z*.

Figure 19:
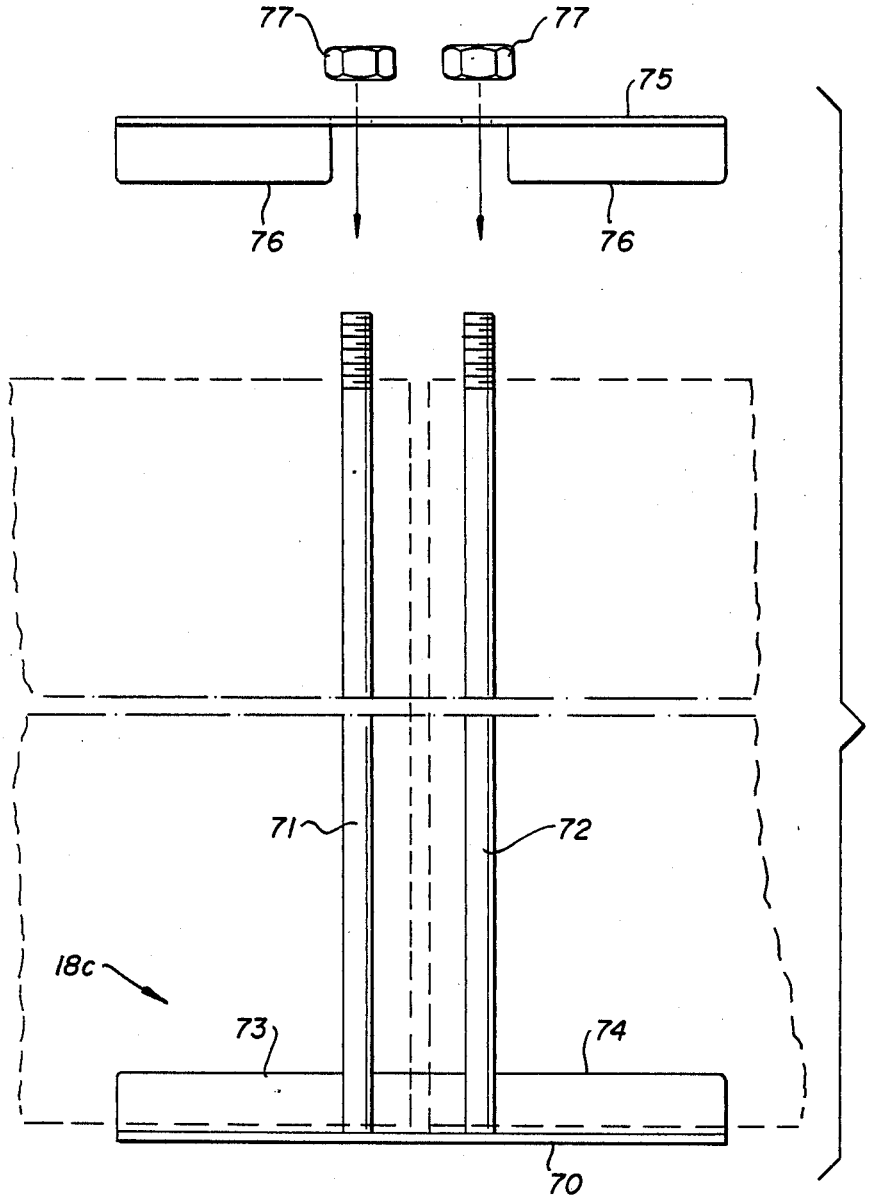
FIG. 19 is a side elevational exploded view of another modified version of the type of connector member shown in FIGS. 11 and 12.

FIG. 19 illustrates a modified connector member 18*e* which is used when the bottom of a pair of laterally abutting panels are not supported below for example in the area at the top of an open window such as area C of FIG. 1. In this case, the lower base 70 includes pins 71 and 72 which extend all the way through their respective channels 30 where they are threadedly engaged at their upper ends by nuts 77. The pins 71 and 72 have corresponding flags 73 and 74. The nuts 77 secure onto the upper ends of the pins 71 and 72 a base 75 with respective flags 76.

Although the invention has been described in considerable detail with respect to preferred embodiments, it will be apparent that the invention is capable of numerous modifications and variations, apparent to those skilled in the art. For example, while several different shapes of connector members have been described herein, it will be apparent that any number of other shapes of connector members can be provided, all with the features as described herein, for connecting the display panels of the exhibit together in different ways. For example, different arrangements of two, three or four panels can come together at a given point and panels can come together along a given plane, at a ninety degree angle or at any other obtuse or acute angle, depending on the needs of a particular exhibit. In these cases the bend in the connector members would accommodate the desired bend in the exhibit, for any desired angle.

I claim:

1. A display component for an exhibit or the like, which component comprises:

a pair of panels having outwardly facing surfaces bounded by edges, the panels being relatively thin compared with the area of their outwardly facing surfaces, a first edge of one panel meting a first edge of the other panel, such that their outwardly facing surfaces together form an essentially coextensive portion of the exhibit, said first meeting edges terminating at least one corner of each panel where each edge turns at substantially ninety degrees onto a second, adjacent edge of the panel, each panel having an at least partially circular channel extending substantially parallel to both of said first and second edges, extending near but spaced inwardly by the same distance as each other from its respective edge, ending at entry openings near the said corner, on the other of said first or second edges, and each channel extending from its entry opening at said other edge, at least partially along its respective edge, such that the two channels intersect each other near the corner where the first and second edges meet, each of said edges which has an entry opening also including a tin central slot extending along the centerline of its outer periphery adjacent each of said entry openings, its depth into its edge being substantially greater than its width across its edge, and a connector member for connecting said pair of panels together, said connecting member comprising a pair of substantially parallel pins, said pins engaging into substantially parallel entry openings, one on each of the two panels of the pair, and hence extending partially into the channel which is an extension of said entry opening and which extends parallel to an edge of the panel which is adjacent to the edge with that entry opening, and said connecting member further including generally flat thin flags which extend generally parallel to each of the pins edgewise into the said thin central slot of the panel adjacent the entry opening of its respective pin such that the plane which includes the flat thin flag is parallel to the outwardly facing surfaces of its panel.

2. A display component according to claim 1, wherein the channels and pins extend perpendicular to said first meeting edges, entering entry openings in the first meeting edges and extending parallel to said second edges.

3. A display component according to claim 2, wherein the said channels and pins are linearly coextensive.

4. A display component according to claim 2, wherein said connector member comprises a base said pair of pins being linearly coextensive with each other, extending on opposite sides of the base, both of said flags lying in a common plane, extending in opposite directions from said base.

5. A display component according to claim 4, including a second pair of panels meeting the first said pair of panels at an angle to the general plane thereof, and said connecting member including a second portion, which is essentially a mirror image of the first said portion of said connecting member, and extending at said angle to the general plane of said first said portion, to connect the two panels of the second pair to each other and to connect the first and second pairs together.

6. A display component according to claim 4, said base including an end flange on the end opposite from said flag, to engage a side of the panel.

7. A display component according to claim 1, wherein the channels and pins extend parallel to said first meeting edges, engaging entry openings in the second edges and extending generally perpendicular to said second edges.

8. A display component according to claim 7, wherein said connector member includes a generally planar base, the two pins extending parallel to each other from and being spaced apart along said base, and each said flag extending perpendicular to the base and adjacent its respective pin, on the side thereof opposite from the other pin.

9. A display component according to claim 8, wherein the panels of the pair meet at an angle to each other, and the base is turned at that angle.

10. A display component according to claim 8, wherein each pin extends along the entire length of its channel, and including connector means for engaging the opposite ends of those pins which emerge from the opposite ends of their respective channels 11. A display component according to claim 1, wherein each of said edges comprises a pair of spline openings extending parallel to the said channel, on each side thereof, to receive the edges of decorative material which covers the outer facing surfaces of that panel.

12. A display component according to claim 1, the panel being formed by a plurality of elongated frame pieces which meet at corners of the panel, the corners being miter joints which are welded together.

13. A display component according to claim 12, wherein each said entry opening enters through one frame piece, near its end, and crosses the welded miter joint and extends, as a channel, along the other frame piece of that miter joint.

14. A display component according to claim 1, wherein the two pins are of different lengths from each other.

15. A display component according to claim 14, wherein the longer pin is less than two inches long and the shorter pin is greater than one inch long.

16. A display component according to claim 1, each connector member having a generally flat base, and said pins and flags extending generally perpendicular to said base, wherein the flags are pieces separate from the material of the base and are welded along one of their edges to the base and are welded along another of their edges to their respective pin.

17. A display component according to claim 1, each connector member having a generally flat base, and said pins and flags extending generally perpendicularly from said base, said flags being the same piece of material as the base and being formed as a ninety degree bend in the material of the base.

18. In combination, a display panel to be connected to other display panels to form an exhibit or the like, and a connector member therefor, said panel having a generally rectangular frame having edges joining opposed facing surfaces, an at least partially circular channel extending along and substantially parallel to at least two adjacent edges of the panel, at least near the ends of their respective edges, each said channel being spaced inwardly from its respective parallel edge and having entry openings in adjacent panel edges, such that the two channels of the panel intersect each other near the corner where the two adjacent edges meet, a thin central slot extending along the centerline of the outer periphery of each of said adjacent edges adjacent their respective entry openings, its depth into its edge being substantially greater than its width across its edge, and a connector member which has a pair of substantially parallel pins, each shaped to fit in a channel, and including a flat flag adjacent each pin and positioned to engage said thin central slot adjacent the entry opening of its respective pin edgewise, such that the plane which includes the flat tin flag is parallel to the outwardly facing surfaces of its panel.

19. The combination of claim 18, the rectangular frame being formed by four individual frame pieces joined at welded miter joints at their corners, and wherein said entry openings enter into one frame piece, near its end, and cross the welded miter joint and extend, as a channel, along the other frame piece of that miter joint.

20. The invention of claim 18, wherein the two pins are of different lengths from each other.

21. The combination of claim 20, wherein the longer pin is not greater than two inches long and the shorter pin is not less than on inch long.

22. The combination of claim 18, each connector member having a generally flat base, and said pins and flags extending generally perpendicular to said base, wherein the flags are pieces separate from the material of the base and are welded along one of their edges to the base and are welded along another of their edges to their respective pin.

23. The combination of claim 18, each connector member having a generally flat base, and said pins and flags extending generally perpendicularly from said base, said flags being the same piece of material as the base and being formed as a ninety degree bend in the material of the base.

24. A display component for an exhibit or the like, which component comprises:

a pair of panels having outwardly facing surfaces bounded by edges, the panels being relatively thin compared with the area of their outwardly facing surfaces, a first edge of one panel meeting a first edge of the other panel, such that their outwardly facing surfaces together form an essentially coextensive portion of the exhibit, said first meeting edges terminating at least one corner of each panel where each edge turns at substantially ninety degrees onto a second, adjacent edge of that panel, each panel having an at least partially circular channel extending substantially parallel to and close to its said first edge, such that the channels are substantially parallel to each other when said first edges are arranged parallel to each other, each panel having a thin slot extending along the centerline of its second edge, its depth into its edge being substantially greater than its width across its edge, and a connector member including a tin flat base, a pair of substantially parallel pins extending substantially perpendicular to said base and shaped to fit into the channels, one into the channel of each panel said connector member also including a thin flat flag extending substantially perpendicular to said base, one flag being parallel to and adjacent to each said pin, each said flag being positioned to fit into a slot of a panel as its adjacent pin fits into the channel of that panel such that the plane which includes the flat thin flag is parallel to the outwardly facing surfaces of this panel.

25. A display component according to claim 24 wherein the channels and pins extend perpendicular to said first meeting edges, entering entry openings in the firs meeting edges and extending parallel to said second edges.

26. A display component according to claim 24, wherein the channels and pins extend parallel to said first meeting edges, engaging entry openings in the second edges and extending generally perpendicular to said second edges.

27. A display component according to claim 24, wherein each of said edges comprises a pair of spline openings extending parallel to the said channel, on each side thereof, to receive the edges of decorative material which covers the outer facing surfaces of that panel.

28. A display component according to claim 24, the panel being formed by a plurality of elongated frame pieces which meet at corners of the panel, the corners being miter joints which are welded together.

29. A display component according to claim 24, wherein the two pins are of different lengths from each other.

* * * * *